United States Patent [19]

Rudick

[11] Patent Number: 4,848,596

[45] Date of Patent: Jul. 18, 1989

[54] DISPOSABLE SYRUP PACKAGE HAVING INTEGRAL DISPOSABLE VALVE ASSEMBLY

[75] Inventor: Arthur G. Rudick, Marietta, Ga.

[73] Assignee: The Coca-Cola Company, Atlanta, Ga.

[21] Appl. No.: 918,714

[22] Filed: Oct. 14, 1986

[51] Int. Cl.[4] ..... B67D 5/64

[52] U.S. Cl. ..... 222/162; 222/505; 222/185; 141/364

[58] Field of Search ..... 141/346, 351, 363, 364, 141/384, 250, 284, 311, 1; 222/160, 162, 167, 168, 505, 511, 515, 544–555, 559, 561, 185; 251/347–348, 353–354; 220/253

[56] References Cited

U.S. PATENT DOCUMENTS

| | | | |
|---|---|---|---|
| 1,165,499 | 12/1915 | Gebhardt | 222/162 |
| 1,226,722 | 5/1917 | Sullivan | 141/346 X |
| 1,553,113 | 9/1925 | Rutt | 222/511 X |
| 2,298,957 | 10/1942 | Mazzarelli | 222/511 X |
| 3,214,069 | 10/1965 | Dike | 222/545 |
| 3,374,811 | 3/1968 | Goosman | 222/318 |
| 3,446,403 | 5/1969 | Serio | 222/162 X |
| 4,216,885 | 8/1980 | Sedam | 222/481 |
| 4,541,541 | 9/1985 | Hickman et al. | 220/253 |
| 4,615,364 | 10/1986 | Kawata | 141/364 |

*Primary Examiner*—Michael S. Huppert

*Attorney, Agent, or Firm*—Birch, Stewart, Kolasch & Birch

[57] ABSTRACT

A disposable syrup package includes an integral valve assembly. The valve assembly includes a movable plate with an aperture that lines up with a discharge opening of a container in an open position. In a first embodiment, the plate is mounted for reciprocating movement in a slot in the discharge wall of the container and is spring biased to a closed position. In a second embodiment, the plate is mounted for rotation and includes an arcuate slot alignable with the discharge opening.

1 Claim, 1 Drawing Sheet

DISPOSABLE SYRUP PACKAGE HAVING INTEGRAL DISPOSABLE VALVE ASSEMBLY

BACKGROUND OF THE INVENTION

The present invention relates to a disposable syrup package for use in a post-mix beverage dispensing system. More specifically, the present invention relates to a disposable syrup package having an integral dispensing valve assembly disposed in a discharge end of the package.

An examplary disposable syrup package of the prior art is disclosed in U.S. Pat. No. 4,216,885 to Sedam, issued Aug. 12, 1980 and assigned to the same assignee as the present invention. The disposable syrup package of Sedam is designed for use with a separate valve assembly included within the post-mix dispensing apparatus. The valve assembly has a piercing device which ruptures a frangible membrane in the discharge end of the syrup package as the syrup package is plugged into a socket associated with the valve assembly.

Although the Sedam syrup package and associated valve assembly work quite well, it would be desirable to provide a less expensive valve assembly integrally formed with the syrup package and eliminate the frangible membrane and protective cap which is now part of the Sedam disposable syrup package.

SUMMARY OF THE INVENTION

Accordingly, it is a primary object of the present invention to provide a disposable syrup package including a disposable integral valve assembly associated with the discharge edd of the syrup package.

It is another object of the present invention to provide a valve assembly associated with the discharge end of the syrup package having a minimum number of moving parts to achieve high reliability and maintain the cost of the package within reasonable limits.

The objects of the present invention are fulfilled by providing an apparatus for dispensing liquids through an opening in a discharge wall of a container comprising: plate means disposed adjacent the discharge wall of the container, said plate means having an open position for accommodating the flow of liquid from the container and a closed position for blocking the flow of liquid from the container, said plate means being movable in a plane parallel to a plane defined by said discharge wall, said plate means including aperture means alignable with the opening in the discharge wall in the open position of the plate means.

Further scope of applicability of the present invention will become apparent from a detailed description given hereinafter. However, it should be understood that the detailed description and specific examples, while indicating preferred embodiments of the invention, are given by way of illustration only, since various changes and modifications with the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
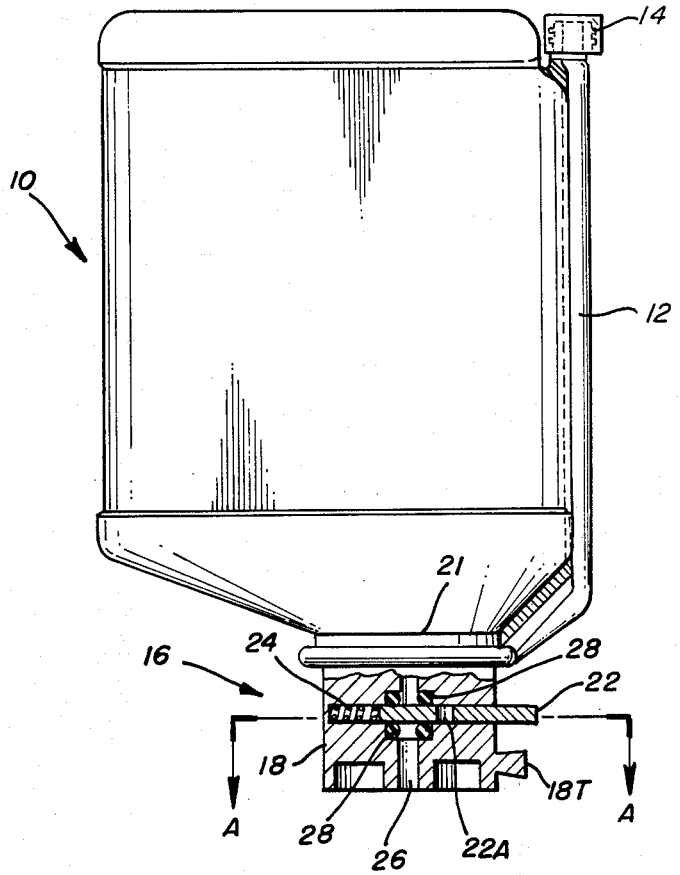
FIG. 1 is a side elevational view of a first embodiment of the syrup package of the present invention including an integral valve assembly.
Figure 2A:
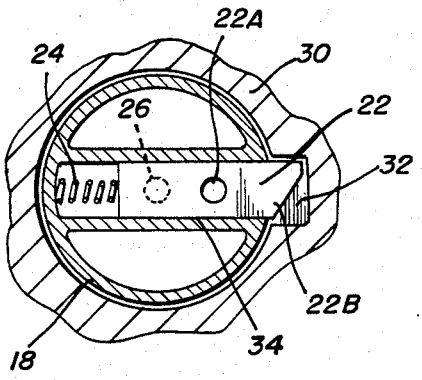
FIGS. 2A and 2B are cross-sectional views taken along line A—A of FIG. 1 showing the valve assembly in the closed and open positions, respectively.
Figure 2B:
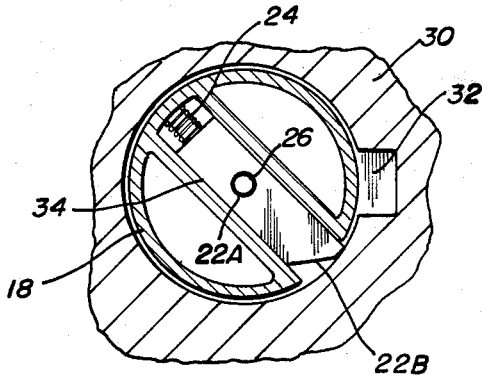

Referring to FIGS. 1, 2A and 2B, there is generally illustrated a syrup package 10 having a flow rate control tube 12 which is normally closed to the atmosphere by a removable cap 14. The operation of the syrup package 10 including the flow rate control tube 12 is generally described and is similar to the operation of the syrup package disclosed in the aforementioned U.S. Pat. No. 4,216,885 to Sedam. However, the syrup package in FIG. 1 is also provided with an integral valve assembly generally designated 16 associated with the discharge neck 18 of the container and the discharge wall 21.

The end wall 21 of container 10 is closed by an adaptor block forming an elongated neck portion 18. A discharge opening or bore 26 extends through the adaptor block. A slot 34 is also formed in the block transversely of the discharge bore 26 for accommodating a movable actuator plate 22. Actuator plate 22 is provided with a discharge aperture 22A, and is spring biased by a coil spring 24 to a normally-closed position illustrated in FIGS. 1 and 2A. Bore 26 has a relieved portion in which a pair of O-rings 28 may be provided to seal bore 26 when actuator plate 22 is in the closed position, and to prevent leakage around aperture 22A in the open position.

Actuator plate 22 is also provided with an angular end 22B operatively associated with a stationary slot 32 formed in a stationary portion 30 of the post-mix beverage dispenser, into which the syrup package 10 is to be inserted. Neck 18 is provided with an actuation tab 18T which may be operatively associated with a rotating ring (not shown) of the dispenser, or may facilitate manual rotation of the container 10 and neck 18 between the two respective positions illustrated in FIGS. 2A and 2B.

It can be seen from reference to FIGS. 2A and 2B that when container 10 and neck 18 are rotated by means of the actuation tab 18T, plate 22 rotates with respect to the stationary support 30 and slot 32 therein, and the angular end 22B is engaged and depressed by support 30 to reciprocate plate 22 until aperture 22A is in alignment with discharge bore 26. In this position, syrup or other liquid is free to flow through discharge bore 26 and aperture 22A into the post-mix beverage dispenser.

Figure 3:
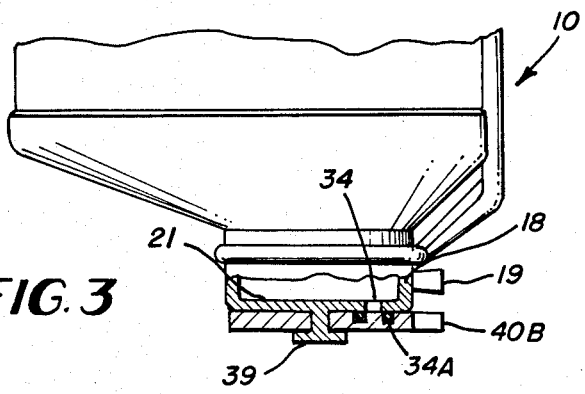
FIG. 3 is a partial side elevational view of a second embodiment of the syrup package of the present invention illustrating a different form of valve assembly.
Figure 4:
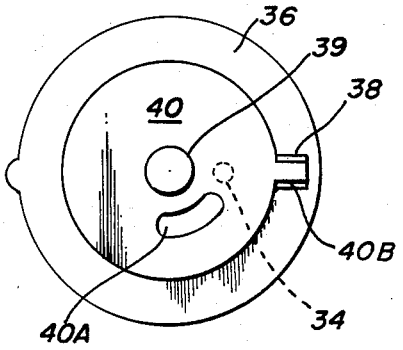
FIG. 4 is a bottom plan view of the valve assembly portion of the syrup package of FIG. 3 and the operative association thereof with an actuator ring, assembly portion of the syrup package.

Referring now to FIGS. 3 and 4, there is illustrated a second embodiment of an integral valve assembly of the present invention. In the embodiment of FIGS. 3 and 4, the discharge end wall 21 is provided with a pin 39 which forms an axis about which a plate 40 may be rotated between open and closed positions with respect to an orifice 34 in wall 21. A suitable seal 34A may be provided around the orifice 34. Rotatable plate 40 is provided with an arcuate slot 40A which is movable between a closed position (see FIG. 4) and an open position in which slot 40A lines up with orifice 34. Rotation of plate 40 may be achieved by a rotatable slotted ring 36 having a slot 38 which is operatively associated with an actuation tab 40B of plate 40. A tab 19 is provided on neck 18 and cooperates with a stationary slot, such as 32, in a stationary support 30 of the type illustrated in FIGS. 2A and 2B.

To dispense syrup from container 10 in the embodiment of FIGS. 3 and 4, either the actuation ring 36 rotates to engage actuation tab 40B which rotates slot 40A into alignment with orifice 34, or tab 40B can be manually engaged to rotate plate 40. Since the container is held stationary by tab 19, the rotation of plate 40 causes the opening or closing of orifice 34.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a post-mix beverage dispensing system, an apparatus for dispensing syrup through an opening in a discharge wall of a disposable container the improvement comprising:

plate means disposed adjacent to and mounted for reciprocating movement in a slot formed in the discharge wall of the container and intersecting said discharge opening, said plate means having an open position for accommodating the flow of liquid from the container and a closed position for blocking the flow of liquid from said container;

spring means for normally biasing said plate means to said closed position; and said plate means being movable in a plane parallel to a plane defined by said discharge wall, said plate means including aperture means alignable with the opening in the discharge wall in the open position of the plate means and an angled actuation end operatively associated with a stationary cam surface adjacent the discharge wall of said container, said actuation end being depressed against said spring means by said cam surface in response of rotation of said plate means about a longitudinal axis of said container.

* * * * *